US005759011A

United States Patent [19]

Moll

[11] Patent Number: 5,759,011

[45] Date of Patent: Jun. 2, 1998

[54] JOURNAL BEARING ASSEMBLY

[75] Inventor: Randall W. Moll, Scio, N.Y.

[73] Assignee: Dresser-Rand Company, Corning, N.Y.

[21] Appl. No.: 645,772

[22] Filed: May 14, 1996

[51] Int. Cl.[6] ..... F04D 29/08

[52] U.S. Cl. ..... 415/170.1; 384/309; 384/312

[58] Field of Search ..... 415/170.1, 104, 415/107, 229; 384/309, 312, 317

[56] References Cited

U.S. PATENT DOCUMENTS

| | | |
|---|---|---|
| 4,381,128 | 4/1983 | Vohr . |
| 4,490,054 | 12/1984 | Kimmelaar . |
| 4,497,587 | 2/1985 | Pine . |
| 4,597,676 | 7/1986 | Vohr et al. . |
| 4,643,592 | 2/1987 | Lewis et al. . |
| 4,746,230 | 5/1988 | Jensen . |
| 4,815,865 | 3/1989 | Gerling . |
| 5,160,247 | 11/1992 | Kandpal . |
| 5,209,579 | 5/1993 | Matake . |
| 5,222,815 | 6/1993 | Ide . |
| 5,223,756 | 6/1993 | Bello . |
| 5,223,758 | 6/1993 | Kataoka et al. . |
| 5,271,676 | 12/1993 | Keck et al. . |
| 5,277,500 | 1/1994 | Keck . |
| 5,288,153 | 2/1994 | Gardner . |

*Primary Examiner*—John T. Kwon

*Attorney, Agent, or Firm*—Nixon, Hargrave, Devans & Doyle

[57] ABSTRACT

A journal bearing assembly for mounting within a rotatable shaft that has been hollowed out to form a shaft cavity, said assembly comprising a plurality of bearing pads positioned about a bearing support, said support and bearing pads positioned within the hollowed out shaft end, said bearing pads then positioned between the bearing support and the shaft cavity wall.

23 Claims, 4 Drawing Sheets

10

JOURNAL BEARING ASSEMBLY

FIELD OF THE INVENTION

The present invention relates generally to hydrodynamic bearing assemblies for rotatable shafts, and more specifically to a tilting pad journal bearing assembly for turbomachine shafts.

BACKGROUND OF THE INVENTION

In hydrodynamic bearing assemblies, a rotating object, such as a shaft is supported by a stationary bearing pad via a pressurized fluid such as oil, air or water. Hydrodynamic bearings take advantage of the phenomenon that when the rotating object moves, it does not slide along the top of the fluid. Instead, the fluid in contact with the rotating object adheres tightly to the rotating object, and motion is accompanied by slip or shear between the fluid particles through the entire height of the fluid film. Thus, if the rotating object and the contacting layer of fluid move at a velocity which is known, the velocity of the fluid at intermediate points throughout of the fluid thickness decreases at a known rate until the fluid in contact with the stationary bearing pad adheres to the bearing pad and is motionless. When, by virtue of the load resulting from its support of the rotating object, the bearing pad is deflected at a small angle to the rotating member, the fluid will be drawn into the wedge-shaped opening and sufficient pressure will be generated in the fluid film to support the load of the rotating member. This system is utilized in thrust bearings for turbomachinery, hydraulic turbines and propeller shafts as well as in conventional hydrodynamic journal bearings.

Both thrust bearings and journal bearings normally are characterized by shaft supporting pads spaced about an axis. The axis about which the pads are spaced generally corresponds to the longitudinal axis of the shaft to be supported for both thrust and journal bearings.

As turbine shafts begin to rotate, and as the rotational velocity increases, vibrations, known as "natural" vibrations occur at specific and predictable frequencies. Such vibrations can cause problems. The vibrational forces associated with the natural frequency of the rotor at the so-called "critical speeds" are well documented. The greater the flex in the rotor, the more violent is the vibration. Therefore, in an attempt to lessen the degree of vibration in apparatuses having rotating members such as shafts, it is desirable to stiffen the shaft. One way to stiffen the shaft of the turbine is to increase the shaft diameter, as the deflection of a supported shaft decreases by the square of the diameter. Deflection is defined according to the following formula:

$$\text{Deflection} = \frac{0.017WL^3}{EI}$$

wherein: W=shaft weight

L=span between supports

E=modulus of elasticity

I=area moment of inertia

However, practical considerations usually require the diameters of the shaft ends to decrease, such as to accommodate bearing cases and pressure vessel seals. Unfortunately, as the shaft diameter and accompanying bearings get smaller (near the shaft end), the shaft ends become more flexible and vibrations associated with the second rigid mode "critical speed" increase.

Therefore, to insure a high degree of rotor stiffness and low vibration levels, it is desirable to have as large a diameter as possible at the end of the shaft. Unfortunately, a shaft having a large diameter will also have a large circumference. If the bearings are placed conventionally on the outside of the larger shaft, larger journal bearings will be required. However, journal bearings are very expensive to manufacture; manufacturing expense increasing commensurate with bearing size. The larger bearing case housings needed to cover such bearing assemblies would also increase unit cost.

Further, overall turbomachine efficiency is impacted by the selected diameter size of the shaft. Frictional power loss associated with a bearing assembly increases as the cube of the diameter. Increased frictional power loss decreases machine efficiency and requires the removal of more heat from the bearing, increasing operating costs.

A bearing system for rotatable objects which can be used with a large end shaft diameter to counter vibration problems, but which uses smaller journal bearings would be highly advantageous.

SUMMARY OF THE INVENTION

One aspect of the present invention is directed to a journal bearing assembly for a rotatable shaft. The rotatable shaft has an axis extending longitudinally between two ends. One or both of the ends of the shaft have a hollow end capacity defined by a wall coaxial with the axis of said shaft. A bearing support having an outer surface is provided to the shaft and positioned at least partially within the shaft cavity. A plurality of bearing pads having an inner surface and an outer surface are placed circumferentially about and attached to the outer surface of the portion of the bearing support and positioned within the shaft cavity wall, between the bearing support outer surface and the shaft cavity wall.

Another aspect of the invention relates to a turbomachine assembly comprising a rotatable shaft having an axis extending longitudinally between two ends. One or both of the ends of the shaft have a hollow end cavity defined by a wall coaxial with the axis of said shaft. A rotatable turbine wheel or rotor, a stationary diaphragm, and a rotatable shaft having a hollow end shaft cavity having a shaft cavity wall coaxial with the axis of the shaft. At least one rotatable rotor having a plurality of circumferentially placed blades is fixably attached to the shaft. At least one stationary diaphragm having a plurality of circumferentially positioned vanes and a central opening is placed adjacent the rotatable rotor. The central opening is dimensioned to accommodate the shaft axially. A housing covers the turbine rotor, shaft and diaphragm. At a shaft end, a bearing case is attached to the turbomachine housing and covers a bearing support having an outer surface. The bearing support is at least partially positioned within the shaft cavity, and a plurality of bearing pads having an inner surface and an outer surface are positioned circumferentially about, and attached to, the outer surface of the bearing support. In this way the bearing pads are positioned between the outer surface of the bearing support and the shaft cavity wall.

Still another aspect of the present invention relates to a method of supporting a rotatable shaft. A rotatable shaft having an axis extending longitudinally between two ends. One or both of the ends of the shaft have a hollow end shaft cavity defined by a wall coaxial with the axis of the shaft. A bearing support having an outer surface is provided and positioned at least partially within the shaft cavity. A plurality of bearing pads having an inner surface and an outer surface are positioned circumferentially about, and attached to, the outer surface of the bearing support, and are positioned within the shaft cavity. The bearing pads are oriented such that their outer diameter surface is proximate the wall of the shaft cavity. The bearing pads are therefore positioned within the shaft, between the outer surface of the bearing support and the wall of the shaft cavity.

DETAILED DESCRIPTION OF THE INVENTION

Figure 1:
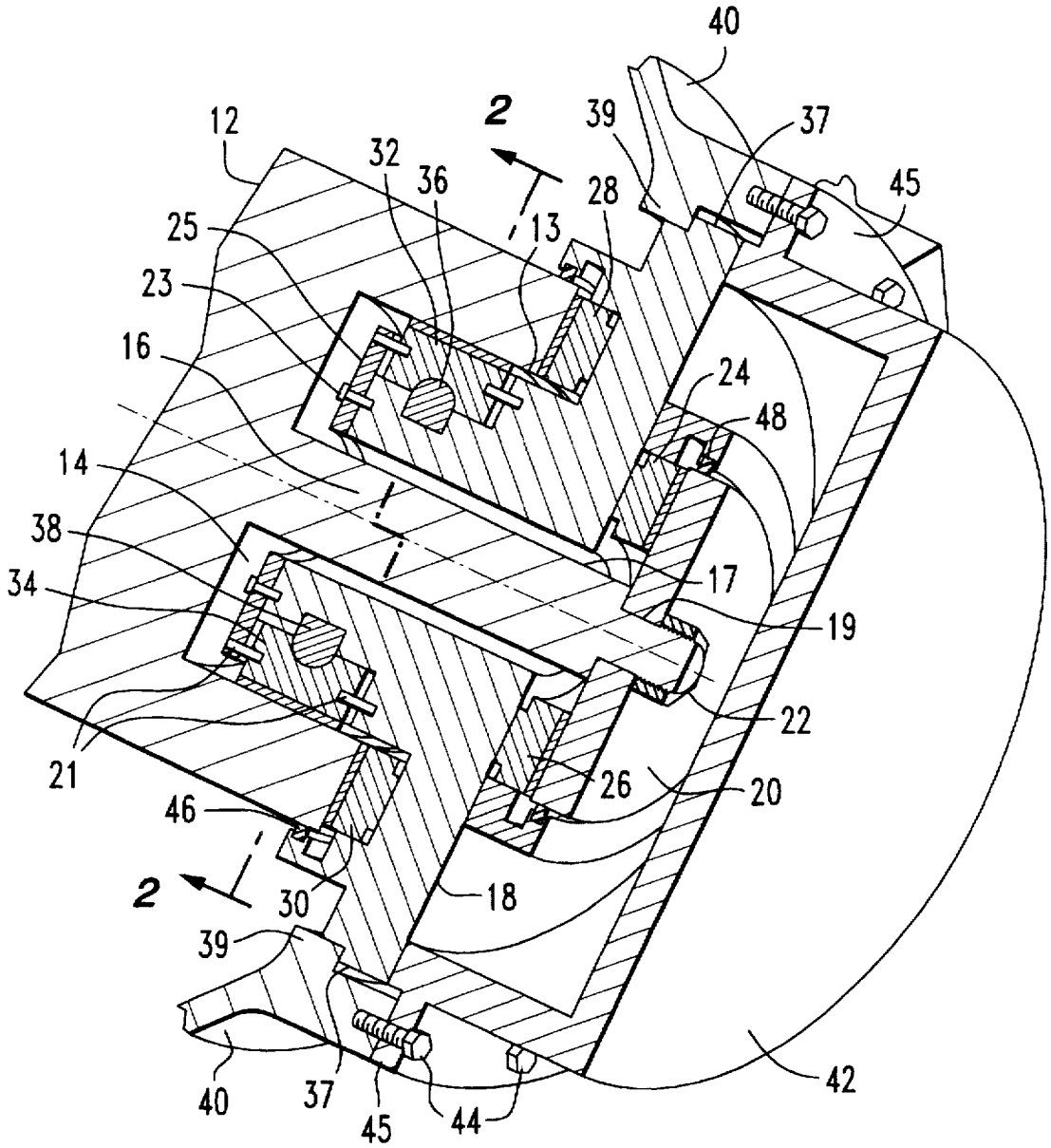
FIG. 1 is a longtudinal cross-sectional view of the shaft end and journal bearing assembly.

FIG. 1 shows a longitudinal cross-sectional view of the shaft end journal assembly 10 of the present invention. One end of rotatable shaft 12 is shown having cavity 14 hollowed out. In a preferred embodiment, the cavity is hollowed out such that a central spindle 16 is coaxial and extends from shaft 12. Bearing support 18 comprises hollow central bore 17 through which shaft spindle 16 is directed. In a preferred embodiment, shaft spindle 16 is passed through the bore 17 in bearing support 18, and passes through a central opening 19 in collar 20, and engages securing nut 22 having threads that engage matching threads machined into the terminal end of shaft spindle 16. Collar 20 is preferably circular, but may be of any geometrical shape limited only by available space and design constraints. Thrust bearing pads 24, 26 are shown attached to bearing support 18 via support pins (not shown) and positioned axially between bearing support 18 and collar 20. Bearing support 18 further supports additional thrust bearings 28, 30 that are positioned via support pins (not shown) axially between the terminal end of shaft 12 and bearing support 18. Tilting pad journal bearing pads 32, 34 are attached to bearing connectors 36, 38 which are mounted within bearing support 18 in a manner allowing for movement in multiple directions. The tilting pad journal bearing pads are held loosely in place on either side by retaining pins 21. On one side of the journal bearing pad, retaining pins 21 extend into the journal bearing pad from retaining plate 25. On the other side of the journal bearing pad, retaining pins extend into the bearing pad from bearing support 18. Retaining plates 25 are fastened to bearing support 18 via securing pins 23. Journal bearing pads 32 and 34 are circumferentially spaced between the outer surface of bearing support 18 and inner wall 13 of shaft cavity 14. Flange 37 of bearing support 18 abuts flange 39 of bearing case 40. Bearing case end cover 42 is fixedly attached to bearing case 40 by connectors 44 passing through bearing case end cover flange 45 into bearing case 40. Seal 46 is located within a notch in bearing support 18 to keep lubricant within the system. Similarly seal 48 is located between collar 20 and the terminal end of bearing support 18.

Figure 2:
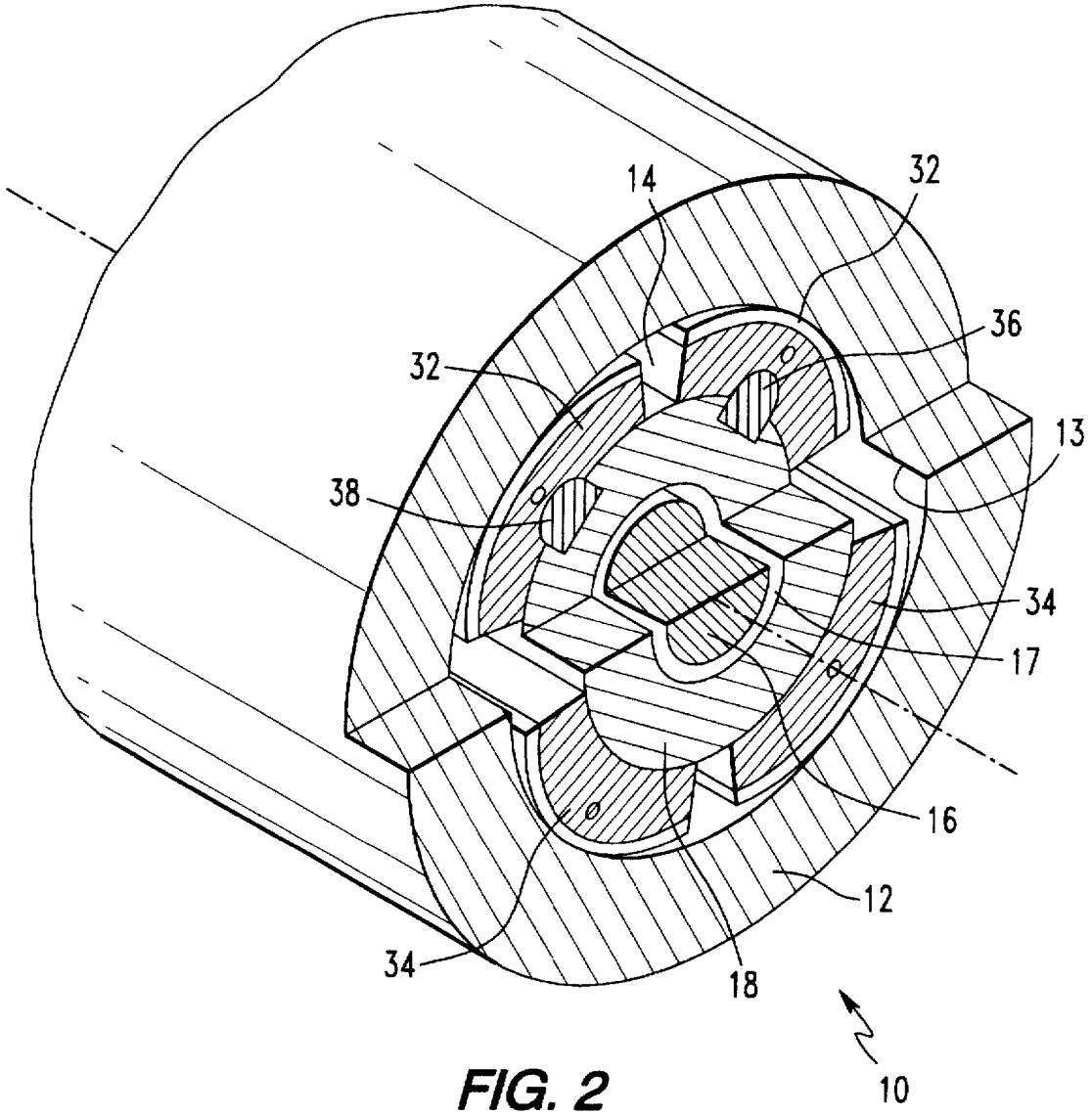
FIG. 2 is a lateral cross-sectional view of the journal bearing assembly of FIG. 1 cut along line 2—2.

FIG. 2 shows a lateral cross-sectional view of rotating shaft 12 along line 2—2 of FIG. 1. Rotatable shaft 12 has hollowed out cavity 14 and through shaft spindle 16 which is directed through bearing support 18. Tilting pad journal bearing pads 32, 34 are attached to bearing support 18 with bearing connectors 36, 38 and are disposed between inner wall 13 of shaft cavity 14 and bearing support 18.

Figure 3:
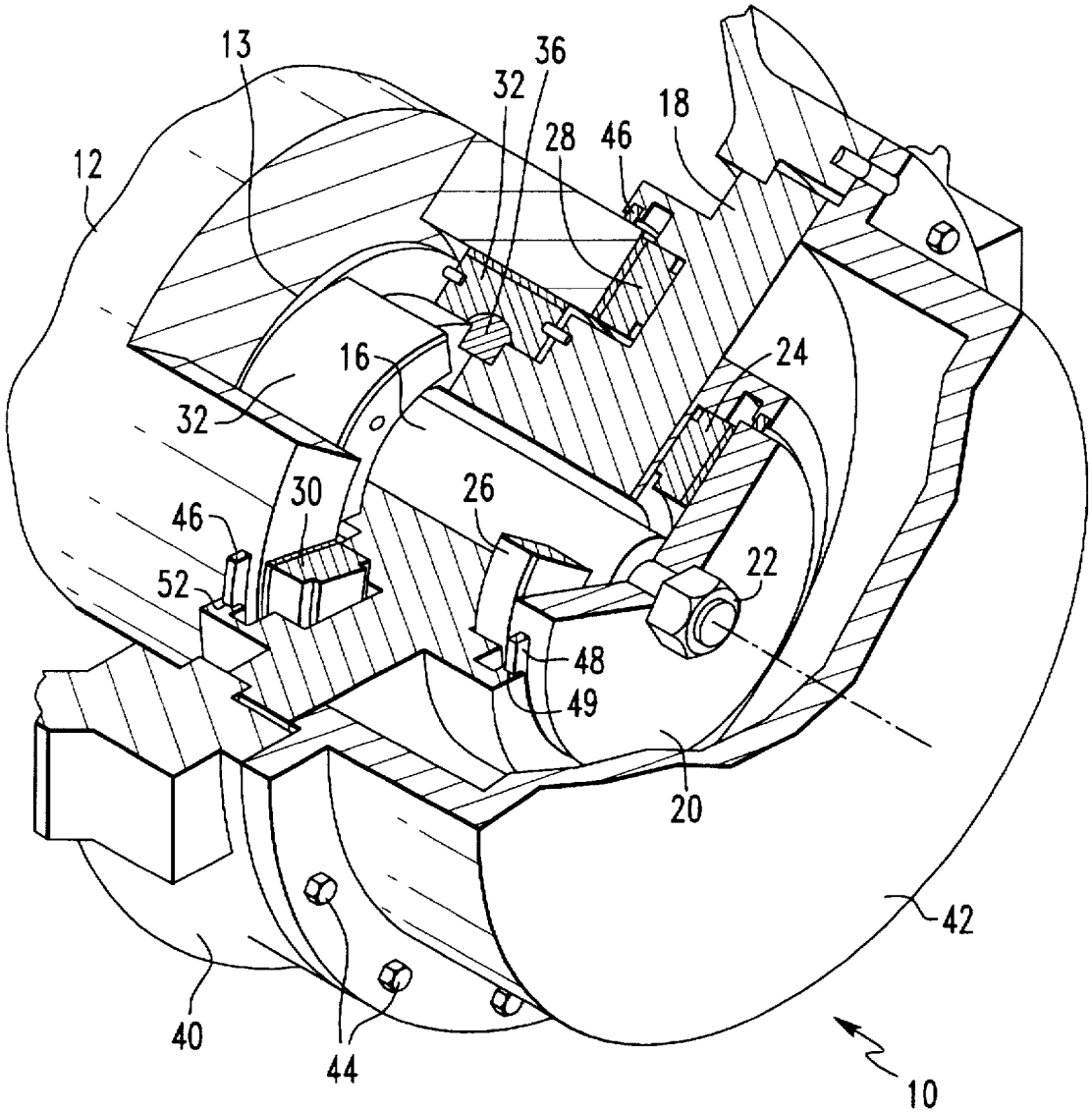
FIG. 3 is an enlarged partially exposed perspective view of the end of the shaft end journal bearing assembly.

FIG. 3 shows an exposed sectional view of the steam end bearing case housing the journal bearing assembly 10 at the end of the rotor of a turbomachine. The bearing case end cover 42 is joined to the bearing case 40 by connectors 44. The bearing case end cover 42 abuts stationary bearing support 18 to which is fitted journal bearing pad 32 and thrust bearings 24, 26, 28, 30. Bearing connector 36 connects journal bearing pad 32 to bearing support 18. The rotatable rotor or shaft 12 is hollowed out creating cavity 14 and central spindle 16 onto which is fitted bearing support 18. Journal bearing pads 32 are located between bearing support 18 and the outer wall of shaft cavity 14. Thrust collar 20 is fitted against the terminal end of the rotor spindle 16 and secured in place by nut 22. Thrust bearing pads 24, 26 are fixably attached to the bearing support 18 and positioned between bearing support 18 and thrust collar 20. Seal 46 is placed into channel 52 in bearing support 18. Seal 48 is placed into channel 49 in bearing support 18 and fitted circumferentially against the outer edge of thrust collar 20. Thrust bearing pads 28, 30 are attached preferably loosely to bearing support 18 with positioning pins (not shown) anchored in the bearing support and extending into holes made in the thrust bearings to receive such pins. Thrust bearing pads 28, 30 are positioned between bearing support 18 and the outer wall of shaft cavity 14.

Figure 4:
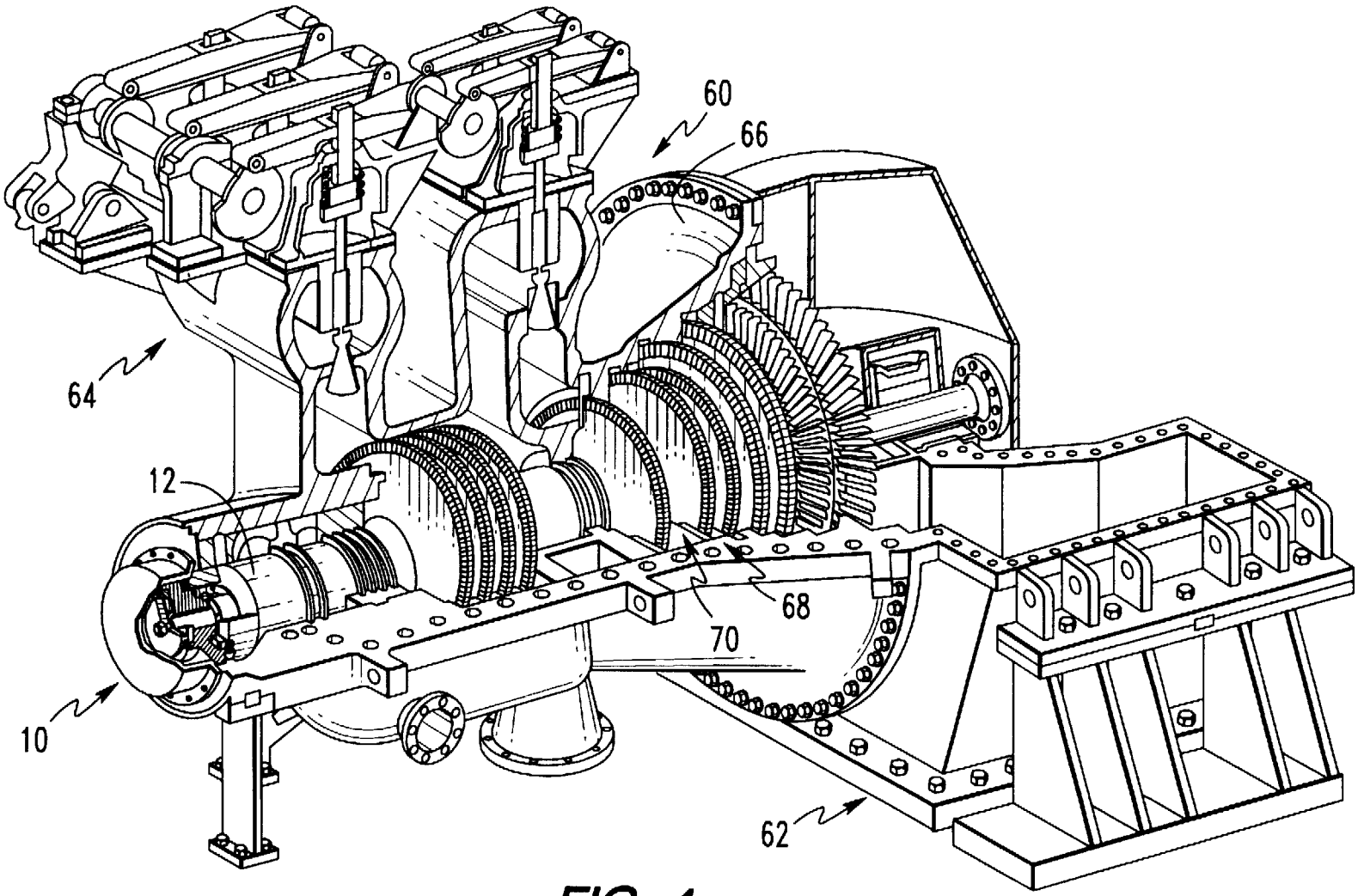
FIG. 4 is an exposed side view of a turbomachine assembly incorporating the journal bearing assembly at the shaft end.

FIG. 4 shows a side view of a turbomachine assembly. The turbomachine 60 has an exhaust end 62 and an inlet end 64. Turbomachine casing 66 houses the rotating turbine wheel or rotor 68 which is attached to the turbomachine shaft 12, and the stationary diaphragm 70 located between turbine wheels 68. At one end of the turbine opposite the exhaust end is located the inlet end bearing case 10 which houses the journal bearing assembly as shown in FIGS. 1–3. The journal bearing pads located inside the end of the hollowed out shaft 12, and the thrust bearings are partially visible in this view.

Each bearing pad preferably is arcuate in configuration and includes a leading edge and a trailing edge. The pad is positioned such that its outer convex surface closely matches the concavity of the shaft cavity wall. The leading edge of the journal bearing pad is defined as the edge first approached by a point on the circumference of the shaft as it continues to rotate. Similarly, the trailing edge is defined as the edge approached circumferentially later by the same point on the shaft as it continues to rotate. When the shaft is rotating in the proper direction, it moves, on a fluid film, from the leading edge across the bearing pad and off the trailing edge.

Although specific reference is made to either journal bearings or thrust bearings to facilitate an understanding of the invention, some of the same principles apply regardless of the specific form of the bearing being designed. For example, both journal and thrust bearings operate on the principle of formation of a hydrodynamic wedge. However, there are also significant differences between thrust and journal bearings. The most prominent difference is, of course, the portion of the shaft supported and consequently the orientation and/or attitude of the bearing pad supports. For instance, while journal bearings support circumferential portions of shafts, thrust bearings support shoulder or axial end portions of shafts. Other differences follow from this fundamental difference. For example, in a radial or journal bearing the pads in the direction of the load take or support the load. In a thrust bearing, all pads normally share load. Moreover, a journal bearing generally has a built-in wedge due to differences in the shaft and bearing diameters. There may be no such built-in wedge in thrust bearings. Additionally, while a journal or radial bearing controls rotational stability as well as load, a thrust bearing typically only carries load.

Bearing pads may be babbitted or not and are made from a variety of materials such as carbon steel, stainless steel, bronze, copper alloys, ceramic, ceramic composites, plastics, and preferably lead-tin babbitted steel alloy pads. The lead-tin babbitted steel alloy pads are preferred for use in turbomachines. Babbitted pads are understood to be pads incorporating a thin layer of material such as lead-tin preferably heat-bonded to the metal pad. These pads are rigid enough to support the journal load, and possess adequate heat transfer properties to transmit the heat created in the fluid film during operation. Such pads also provide adequate coefficients of friction for initial rotation breakaway and are commercially available.

A lubricant fluid is provided to the bearing assemblies as a natural or synthetic lubricating oil or other hydraulic fluid lubricant as would be conventionally used for lubricating such systems. The fluid is provided under relatively low pressure, for example about 25 psi, to the bearing assembly via piping not shown in the diagrams, but which would be readily understood by those skilled in the field of bearings and turbomachine operation. The fluid is retained in the system by appropriately positioned seals, such as ring seals which guard against leakage. Such seals may be made from any suitable materials as would be readily understood by one skilled in the field, and are preferably made from bronze.

While it is necessary to provide a fluid-film clearance between the bearing pad surface and the shaft portion to be supported, such clearance must not be so great as to contribute to vibrational and other destabilizing forces. Therefore there must be extremely close machining tolerances to effect specific close distances between, for example, the shaft and the bore of the bearing support, as well as between the journal pads (and thrust bearings) and the outer wall of the shaft cavity. These parts are machined to yield gaps of from about 1 to about 20 mils, with a tolerance of from about 0.5 to about 2 mils being particularly preferred. Actual tolerances will vary depending upon the overall dimension of the turbomachine as would be readily understood.

While it is preferable to hollow out the shaft end to create a central spindle on which the bearing support may be placed and retained, such an arrangement is not the only configuration contemplated by the present invention. In an alternate embodiment, a shaft end may be completely hollowed out, and a solid (non-bored) bearing support inserted accordingly into the shaft end cavity. In this arrangement, the bearing support may be secured in place by some alternate means such as external brackets securing the terminal end of the bearing support to the external bearing casings.

In operation, lubricant fluid is supplied to the shaft end cavity under pressure by an external feed. The shaft end cavity is enclosed within a casing or housing (See FIGS. 1–3). Lubricant is then supplied to the journal bearings and their bearing surfaces. The lubricant is metered to the journal bearings and thus the journal bearing pads are flooded with lubricant. With the shaft rotating, lubricant passes along the journal bearing surfaces and the shaft to locations between the wall of the shaft end cavity and the outer surfaces of the journal bearing pads. The lubricant is delivered in a direction generally tangential to the shaft surface and in the direction of the shaft's rotation to contact the bearing pads.

By placing the journal bearing assembly inside the hollowed out shaft end, much smaller journal and thrust bearing assemblies may be used. This reduces the overall manufacturing and operating costs, as the smaller journal bearings are less expensive to manufacture and operate. As a result of the present invention, the goal of maintaining a large diameter shaft for vibration reduction in combination with a smaller, more economical journal bearing system is achieved. The journal bearing assembly of the present invention is particularly useful in conjunction with steam turbomachines, but could be applied usefully to any system where components rotate and are supported on journals.

While the invention has been shown in connection with specific embodiments, it is not intended to limit the invention to such embodiments, but rather the invention extends to all designs and modifications as come within the scope of the appended claims.

What is claimed:

1. A journal bearing assembly for mounting within a rotatable shaft comprising:

a rotatable shaft having an axis extending longitudinally between two ends, wherein one or both of the ends of said shaft have an end cavity defined by a wall coaxial with the axis of said shaft;

a bearing support having an outer surface and positioned at least partially within the hollow end cavity; and a plurality of bearing pads positioned within the shaft cavity, said bearing pads positioned between the bearing support and the shaft cavity wall, wherein said bearing pads are positioned circumferentially about and attached to the outer surface of the bearing support and said shaft is mounted for rotation about said bearing pads in said hollow end cavity.

2. The bearing assembly according to claim 1, further comprising a bearing case cover assembly comprising a cover with an inner surface and an outer surface and having a circular wall extending from a circumferential flange, said wall continuing into a solid end cover, said flange having a plurality of holes extending through the flange and dimensioned to accomodate fasteners to pass therethrough and into a bearing case housing thereby fixably attaching the cover to the bearing case housing, said inner surface of said cover when fixed in position being in close association with the bearing support.

3. The bearing assembly according to claim 1, wherein the pad journals are tilting bearing pads.

4. The bearing assembly according to claim 3, wherein the tilting bearing pads have an arcuate shape.

5. The bearing assembly according to claim 1, further comprising thrust bearings fixably attached to said bearing support and positioned proximate the rotatable shaft, between the shaft end and the bearing support.

6. The bearing assembly according to claim 1, wherein the bearing support comprises a central bore having a first diameter and the rotatable shaft has a central spindle with a second diameter less than the central bore diameter, said spindle extending through the central bore.

7. The bearing assembly according to claim 6, further comprising a collar to fixably attach the bearing support to the central spindle.

8. The bearing assembly according to claim 7, wherein thrust bearings are attached to the collar and positioned between the collar and the bearing support, adjacent the central spindle.

9. The bearing assembly according to claim 1, wherein said assembly is covered by a bearing case.

10. A turbomachine comprising:

a rotatable shaft having an axis extending longitudinally between two ends, wherein one or both of the ends of said shaft have an end cavity defined by a wall coaxial with the axis of said shaft;

a rotatable rotor having a plurality of circumferentially positioned blades, said rotor fixably attached to said shaft;

a stationary diaphragm having a plurality of circumferentially positioned vanes and a centrally positioned opening dimensioned to accommodate the shaft axially therethrough;

a turbomachine housing covering said rotatable shaft, said rotatable rotor, and said stationary diaphragm; and a bearing casing attached to the turbomachine housing and covering a bearing assembly comprising a bearing support having an outer surface and positioned at least partially within the hollow end cavity, and a plurality of bearing pads positioned within the end cavity between the bearing support and the shaft cavity wall, wherein said bearing pads are positioned circumferentially about and attached to the outer surface of the bearing support and said shaft is mounted for rotation about said bearing pads in said end cavity.

11. The turbomachine according to claim 10, wherein the bearing pads are tilting bearing pads.

12. The turbomachine according to claim 11, wherein the tilting bearing pads have an arcuate shape.

13. The turbomachine according to claim 10, further comprising thrust bearings attached to said bearing support and positioned proximate the rotatable shaft, between the shaft end and the bearing support.

14. The turbomachine according to claim 10, wherein the bearing support comprises a central bore having a first diameter and the rotatable shaft has a central spindle with a second diameter less than the central bore diameter, said spindle extending through the central bore.

15. The turbomachine according to claim 14, further comprising a collar to fixably attach the bearing support to the central spindle.

16. The turbomachine according to claim 15, wherein the thrust bearings are attached to the collar and positioned between the collar and the bearing support, adjacent the central spindle.

17. A method of supporting a rotatable shaft comprising:

providing a rotatable shaft having an axis extending longitudinally between two ends wherein one or both of the ends of said shaft have an end cavity defined by a wall coaxial with the axis of said shaft;

providing a bearing support having an outer surface;

positioning the bearing support at least partially within the end cavity; and providing a plurality of bearing pads positioned within the shaft cavity between the bearing support and the shaft cavity wall, wherein said bearing pads are positioned circumferentially about and attached to the outer surface of the bearing support and said shaft is mounted for rotation about said bearing pads in said end cavity.

18. The method according to claim 17, wherein the bearing pads are tilting bearing pads.

19. The method according to claim 18, wherein the tilting bearing pads have an arcuate shape.

20. The method according to claim 17, further comprising thrust bearings attached to said bearing support and positioned proximate the rotatable shaft, between the shaft end and the bearing support.

21. The method according to claim 17, wherein the bearing support comprises a central bore having a diameter and the rotatable shaft has a central spindle having a diameter less than the central bore diameter, said spindle extending through the central bore.

22. The method according to claim 21, further comprising a collar to fixably attach the bearing support to the central spindle.

23. The method according to claim 22, wherein thrust bearings are attached to the collar and positioned between the collar and the bearing support, adjacent the central spindle.

* * * * *